US010984636B2

(12) United States Patent
Dolezalek et al.

(10) Patent No.: US 10,984,636 B2
(45) Date of Patent: Apr. 20, 2021

(54) MODULAR INDICATOR

(71) Applicant: Banner Engineering Corporation, Minneapolis, MN (US)

(72) Inventors: Charles Dolezalek, Stacy, MN (US); Darrell Raymond Pikkaraine, Elk River, MN (US); Maximilian John Aponte, Shakopee, MN (US); Neal A. Schumacher, Plymouth, MN (US)

(73) Assignee: Banner Engineering Corporation, Minneapolis, MN (US)

( * ) Notice: Subject to any disclaimer, the term of this patent is extended or adjusted under 35 U.S.C. 154(b) by 0 days.

(21) Appl. No.: 16/675,708

(22) Filed: Nov. 6, 2019

(65) Prior Publication Data

US 2020/0074820 A1 Mar. 5, 2020

Related U.S. Application Data

(63) Continuation of application No. PCT/US2009/036761, filed on Jun. 12, 2019, which is a continuation of application No. 16/006,158, filed on Jun. 12, 2018, now Pat. No. 10,475,299, which is a continuation-in-part of application No. 14/803,619, filed on Jul. 20, 2015, now Pat. No. 9,997,031.

(51) Int. Cl.
*G08B 5/38* (2006.01)
*G08B 7/06* (2006.01)
(Continued)

(52) U.S. Cl.
CPC ..... *G08B 5/38* (2013.01); *G08B 7/06* (2013.01); *G08B 21/18* (2013.01);
(Continued)

(58) Field of Classification Search
CPC . F21S 2/00; F21V 23/06; F21V 15/01; F21W 2111/00
See application file for complete search history.

(56) References Cited

U.S. PATENT DOCUMENTS 3,868,671 A 2/1975 Maguire et al.
3,868,682 A 2/1975 Simon et al.
(Continued)

FOREIGN PATENT DOCUMENTS

DE 20 2007 005495 U1 8/2007
EP 2 182 776 A1 5/2010
(Continued)

OTHER PUBLICATIONS

International Search Report and Written Opinion for Application No. PCT/US2019/036761 dated Sep. 18, 2019.

*Primary Examiner* — Hongmin Fan
(74) *Attorney, Agent, or Firm* — Merchant & Gould P.C.20

(57) ABSTRACT

An indicator module includes first electrodes disposed on a first support surface, each of the first electrodes having a flexible portion having a sloped section forming an oblique angle with the first support surface, a second electrodes disposed on a second support surface spaced apart from the first support surface along a longitudinal direction, a set of conductors elongated substantially in the longitudinal direction, each of the first electrodes being electrically connected to the a respective one of the second electrodes via a respective one of the conductors, and an indicator circuit, such as a set of LEDs, electrically connected to one or more of the conductors and adapted to generate a human perceptible signal when the indicator circuit receives electrical power from the one or more of the conductors.

21 Claims, 14 Drawing Sheets

(51) Int. Cl.
*G08B 21/18* (2006.01)
*F21Y 115/10* (2016.01)
*F21W 111/00* (2006.01)
*H05B 45/10* (2020.01)

(52) U.S. Cl.
CPC ..... *F21W 2111/00* (2013.01); *F21Y 2115/10* (2016.08); *H05B 45/10* (2020.01)

(56) References Cited

U.S. PATENT DOCUMENTS 4,839,835 A 6/1989 Hagenbuch
5,327,347 A 7/1994 Hagenbuch
5,416,706 A 5/1995 Hagenbuch
5,453,729 A 9/1995 Chu
D363,036 S 10/1995 Sasaki
D363,250 S 10/1995 Miyatake
D363,675 S 10/1995 Sasaki et al.
5,528,499 A 6/1996 Hagenbuch
5,631,832 A 5/1997 Hagenbuch
5,631,835 A 5/1997 Hagenbuch
5,642,933 A 7/1997 Hitora
5,644,489 A 7/1997 Hagenbuch
5,650,928 A 7/1997 Hagenbuch
5,650,930 A 7/1997 Hagenbuch
5,742,914 A 4/1998 Hagenbuch
5,769,532 A 6/1998 Sasaki
D408,938 S 4/1999 Miyatake
5,952,915 A * 9/1999 Marquardt ..... F21V 23/06 340/332
5,963,126 A 10/1999 Karlin et al.
5,995,888 A 11/1999 Hagenbuch
6,033,087 A 3/2000 Shozo et al.
D428,821 S 8/2000 Matuda et al.
D432,038 S 10/2000 Sasaki et al.
D432,444 S 10/2000 Sasaki et al.
6,135,612 A 10/2000 Clore
6,382,811 B1 5/2002 Bernard
6,409,361 B1 6/2002 Ikeda
6,471,371 B1 10/2002 Kawashina et al.
6,561,719 B1 5/2003 Elsaesser et al.
6,572,242 B2 6/2003 Marquardt et al.
6,586,255 B1 7/2003 Hubert et al.
6,589,789 B1 7/2003 Hubert et al.
6,604,838 B2 8/2003 Jautz
6,632,003 B2 10/2003 Marquardt et al.
6,705,060 B1 3/2004 McGuinness et al.
6,814,610 B2 11/2004 Kurose et al.
6,888,454 B2 5/2005 Kurose
6,964,372 B1 11/2005 Peterson
6,974,414 B2 12/2005 Victor
7,014,030 B2 3/2006 Hendzel et al.
D518,400 S 4/2006 Sasaki et al.
D519,869 S 5/2006 Sasaki et al.
7,224,825 B2 5/2007 Craig et al.
D555,025 S 11/2007 Sasaki et al.
D557,159 S 12/2007 Sasaki et al.
D565,788 S 4/2008 Miyatake
7,436,504 B2 10/2008 Shaw et al.
7,445,360 B2 11/2008 Ikeda
D586,033 S 2/2009 Tominoto
7,545,284 B2 6/2009 Neumann et al.
D598,315 S 8/2009 Miyatake
D598,316 S 8/2009 Kuwano
D598,799 S 8/2009 Shigematsu
7,587,178 B2 9/2009 Marquardt
D604,651 S 11/2009 Shoettle
D604,652 S 11/2009 Shoettle
D606,441 S 12/2009 Miyatake
7,633,029 B2 12/2009 Komori et al.
7,639,148 B2 12/2009 Victor
7,667,149 B2 2/2010 Komori et al.
7,675,426 B2 3/2010 Takada et al.
7,705,745 B2 4/2010 Periot et al.
7,722,215 B2 5/2010 Ward et al.
7,880,637 B2 2/2011 Weiss
7,888,825 B2 2/2011 Iida et al.
7,928,610 B2 4/2011 Iida et al.
7,950,088 B2 5/2011 Dalton et al.
7,956,300 B2 6/2011 Hidaka et al.
7,960,665 B2 6/2011 Saki et al.
7,985,932 B2 7/2011 Yasui et al.
7,994,447 B2 8/2011 Sakai
7,999,200 B2 8/2011 Komori et al.
7,999,693 B2 8/2011 Hohler
8,000,835 B2 8/2011 Friz et al.
D647,812 S 11/2011 Kuwano et al.
D648,241 S 11/2011 Kuwano et al.
D651,109 S 12/2011 Kuwano
D651,110 S 12/2011 Kuwano
D651,111 S 12/2011 Kuwano
D651,112 S 12/2011 Kuwano
D651,113 S 12/2011 Kuwano et al.
8,075,408 B2 12/2011 Hwang
D652,334 S 1/2012 Kuwano et al.
D653,141 S 1/2012 Kuwano
D655,216 S 3/2012 Stuffle
8,120,489 B2 6/2012 Hatanaka et al.
8,192,292 B2 6/2012 Popielarz et al.
8,260,948 B2 9/2012 Chand et al.
8,286,288 B2 10/2012 McAllister et al.
D671,254 S 11/2012 Miyatake et al.
8,395,526 B2 3/2013 Kensy et al.
8,454,169 B2 3/2013 Kaseya
D681,261 S 4/2013 Miyatake et al.
8,456,322 B2 6/2013 Marquardt et al.
8,487,747 B2 7/2013 Morin
8,487,775 B2 7/2013 Victor et al.
8,508,902 B2 8/2013 Yamano et al.
8,542,104 B2 9/2013 Horowitz
D695,951 S 12/2013 Miyatake et al.
8,615,374 B1 12/2013 Discenzo
8,615,834 B2 12/2013 McAllister et al.
8,650,917 B2 2/2014 McAllister et al.
9,997,031 B2 6/2018 Dolezalek et al.
10,475,299 B2 11/2019 Dolezalek et al.
2002/0172040 A1 11/2002 Jautz
2003/0030567 A1 2/2003 Hetzel et al.
2004/0214476 A1 10/2004 Haas et al.
2011/0103050 A1 5/2011 Hochman
2013/0314916 A1 11/2013 Clore
2014/0071681 A1 3/2014 Ghafoori et al.
2015/0198317 A1 7/2015 Feller et al.
2015/0201261 A1* 7/2015 Feller ..... F21V 23/003 381/395

FOREIGN PATENT DOCUMENTS

EP 2 996 442 A1 3/2016
EP 3 121 798 A1 1/2017

* cited by examiner

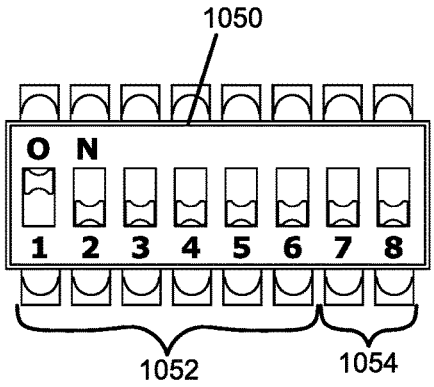
FIG. 10(a)
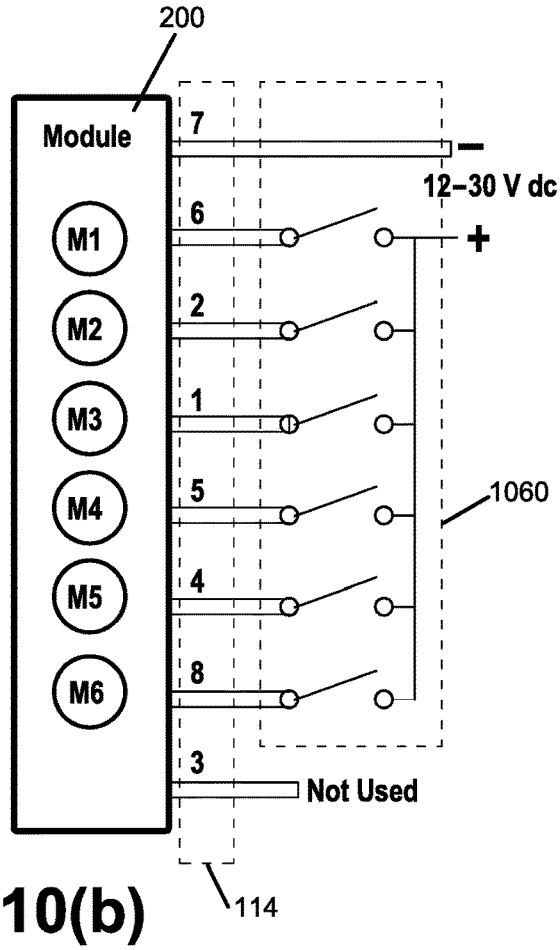
FIG. 10(b)
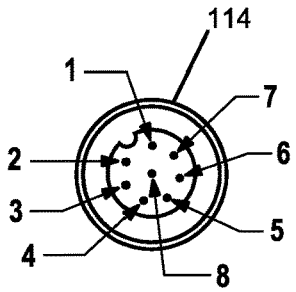
FIG. 10(c)
1 = white
2 = brown
3 = green
4 = yellow
5 = gray
6 = pink
7 = blue
8 = red
M1 = Module 1
M2 = Module 2
M3 = Module 3
M4 = Module 4
M5 = Module 5
M6 = Module 6
FIG. 10(d)

MODULAR INDICATOR

CROSS REFERENCE TO RELATED APPLICATIONS

This application is a continuation of international application Serial No. PCT/US2019/036761, filed Jun. 12, 2019, and designating the United States, which international application claims the benefit of U.S. patent application Ser. No. 16/006,158, filed Jun. 12, 2018, which is a continuation-in-part of U.S. patent application Ser. No. 14/803,619, filed Jul. 20, 2015, and issued as U.S. Pat. No. 9,997,031 on Jun. 12, 2018. This application is also a continuation-in-part of U.S. patent application Ser. No. 16/006,158, which is a continuation-in-part of U.S. patent application Ser. No. 14/803,619. All of the above-referenced prior applications are incorporated herein by reference in their entirety.

BACKGROUND

The present disclosure relates to indicator assemblies having multiple modular indicator elements. Examples of such assemblies include assemblies sometimes known as "tower lights," "stack lights" or "tower stack lights." Such assemblies find wide range of applications, from safety, automation and workflow management in industrial settings to status indication in office settings. In a typical assembly of this kind, multiple indicator modules, such as LED light modules, which are typically cylindrical in shape, are connected together in series along a longitudinal axis. The module at one end of a series is connectable to a base having multiple electrodes, each connected to a wire or connector pin for conducting electrical signal (i.e., power) from a signal source, such as a controller, to the respective electrode. Each module may have multiple conductors running from one end of the module to the other, typically near or inside the cylindrical housing wall of the module. When the modules are connected together, the conductors form multiple conductive paths through the assembly such that each of the conductors in each module is connected to a corresponding electrode in the base to receive an electrical signal. Each module also has one or more indicator circuits, such as LED elements, often with associated electronic components for various purposes, such as intermittent signaling and surge protection. The indicator is typically connected to one of the conductors. The angular position (rotational about the longitudinal axis) between each pair of adjacent modules is typically fixed, for example by bayonet-type mounts. Thus, the order of the modules in the series typically determines which electrode in the base corresponds to the indicator circuit in each module. Such an arrangement imposes certain constraints and complications on the design and deployment of such indicator assemblies and associated components such as controllers and cables.

SUMMARY

In one aspect of this disclosure, an indicator module includes a body portion having a mounting portion, such as a bayonet mount, to removably attach the module to another module, such as a module of the same kind. The module also includes a first plurality of electrodes attached to the body portion and disposed to be in contact with respective ones of a plurality of electrodes in the attached module or base. The indicator module further includes an indicator circuit, such as a visual or audio indicator circuit, and a switch module, such as a DIP switch, operatively connected to the first plurality of electrodes and to the indicator circuit. The switch module is configurable (e.g., by setting the DIP switch) to selectively operatively connect the indicator circuit to one of the first plurality of electrodes. In another aspect of the disclosure, an indicator module described above can further include a second plurality of electrodes, each operatively connected to a respective one of the first plurality of electrodes by a conductor such as a conductive wire. Each plurality of electrodes is located at one end of the module so that the module can be connected to another indicator module at each end, or another indicator at one end and a base at the other.

In another aspect of the disclosure, the visual indicator in an indicator module with conductive wires described above includes a plurality of light elements, such as LEDs, with the conductive wires disposed in a more interior region of the module as compared to the light elements, which can be distributed near the periphery of the module. Such an arrangement reduces shadows of the wires cast by the light elements which can be visible from the exterior of the module.

In another aspect of the disclosure, the first plurality electrodes can each include a flexible portion so that when the module is removably attached to another module or a base, each electrode in the first plurality of electrodes is biased against the electrode in the other module or base.

BRIEF DESCRIPTION OF THE DRAWINGS

FIG. 1(*b*) illustrates an indicator assembly with multiple indicator modules, including two different types of indicator modules, specifically both audio and visual indicator modules in this example, and a base according to an aspect of the present disclosure.

FIG. 10(*a*) shows a DIP switch as a switch module included as part of an indicator module according to an aspect of the present disclosure.

FIG. 10(*b*) schematically shows wiring for signal (power) supply to the indicator modules in an indicator assembly according to an aspect of the present disclosure.

FIG. 10(*c*) schematically shows an arrangement of pin connections for the connector in an indicator module base according to an aspect of the present disclosure.

FIG. 10(*d*) shows the correspondence between the pins in FIG. 10(*c*) and modules in FIG. 10(*b*).

DETAILED DESCRIPTION

The present disclosure is made with reference to example devices and methods illustrated in the attached FIGS. 1-13. The example devices and methods allows an indicator module in a modular tower light to be conveniently configured to be powered by any chosen one of the plurality of signal lines regardless of the position of the module in the sequence of modules. In addition, or independently, the plurality of signal lines that run through a visual indicator module can be positioned in the interior region of the module relative to visual signal sources (e.g., LEDs) so that shadows of the conductors cast by the visual signal sources are reduced as compared to modules having the signal lines near or inside transparent/translucent module housing wall.

Figures 1A, 1B:
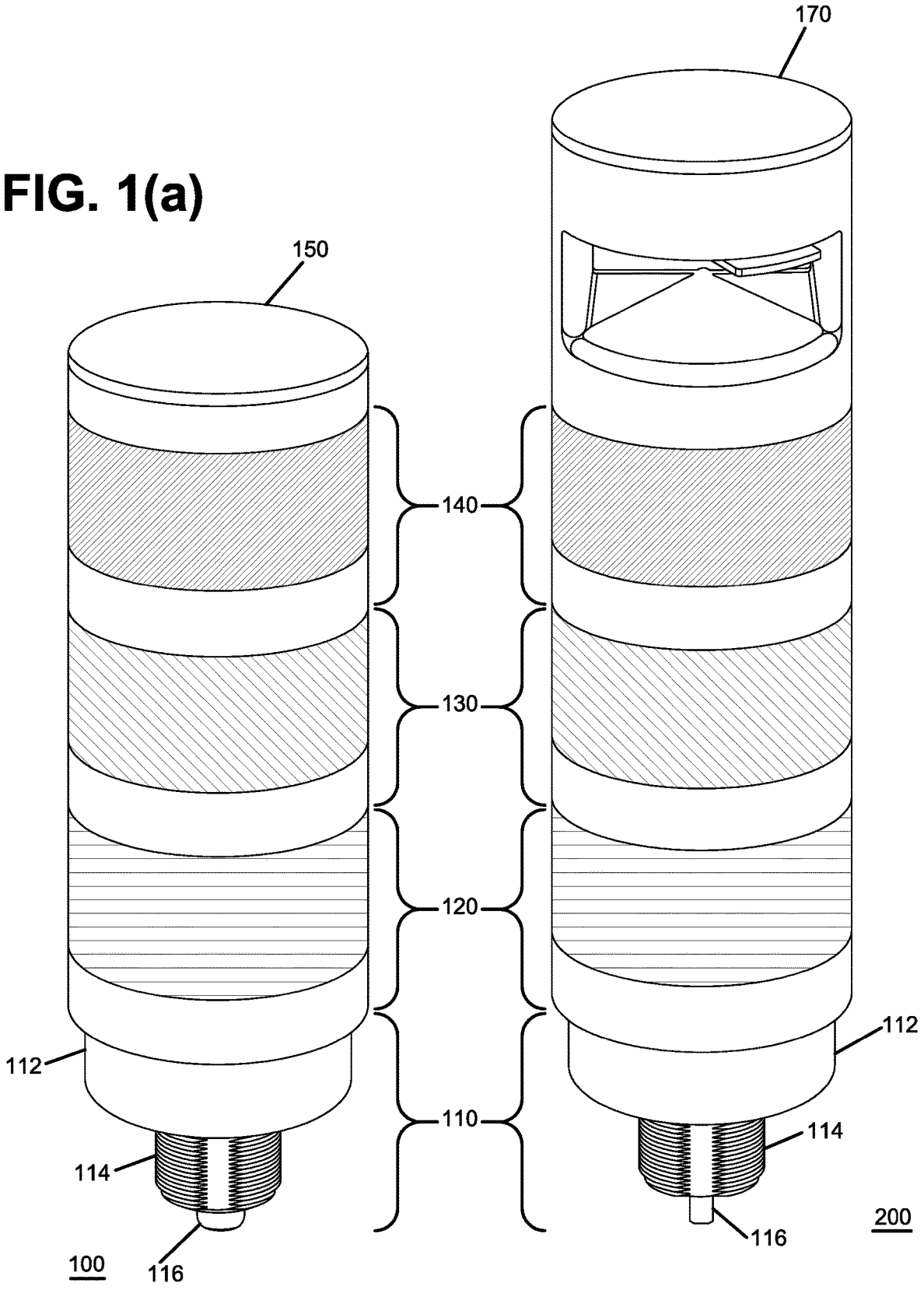
FIG. 1(*a*) illustrates an indicator assembly with multiple indicator modules and a base according to an aspect of the present disclosure.

Referring to FIGS. 1(*a*) and (*b*), example indicator assembles (100, 200) each include a base (110) and several visual indicators (120, 130, 140) mounted on top of each other and on top of the base (110). Each visual indicator (120, 130, 140) can provide a visual indication of a chosen kind, such as color. The top module (140) in assembly (100) can accept additional modules but in this example has a cap (150) mounted at the top. In the assembly (160) in FIG. 1(*b*), an audio indicator module (170) is mounted on top of the top visual indicator module (140). The base (110) includes an indicator mounting portion (112) for attachment to an indicator module (120, 130, 140), a base mounting portion (114) (e.g., a threaded cylindrical portion) for mounting the base on a support such as a bracket, and a connector (116) for electrical connection between the assembly and one or more signal sources, such as a controller, via one or more electrical cables.

Figure 2:
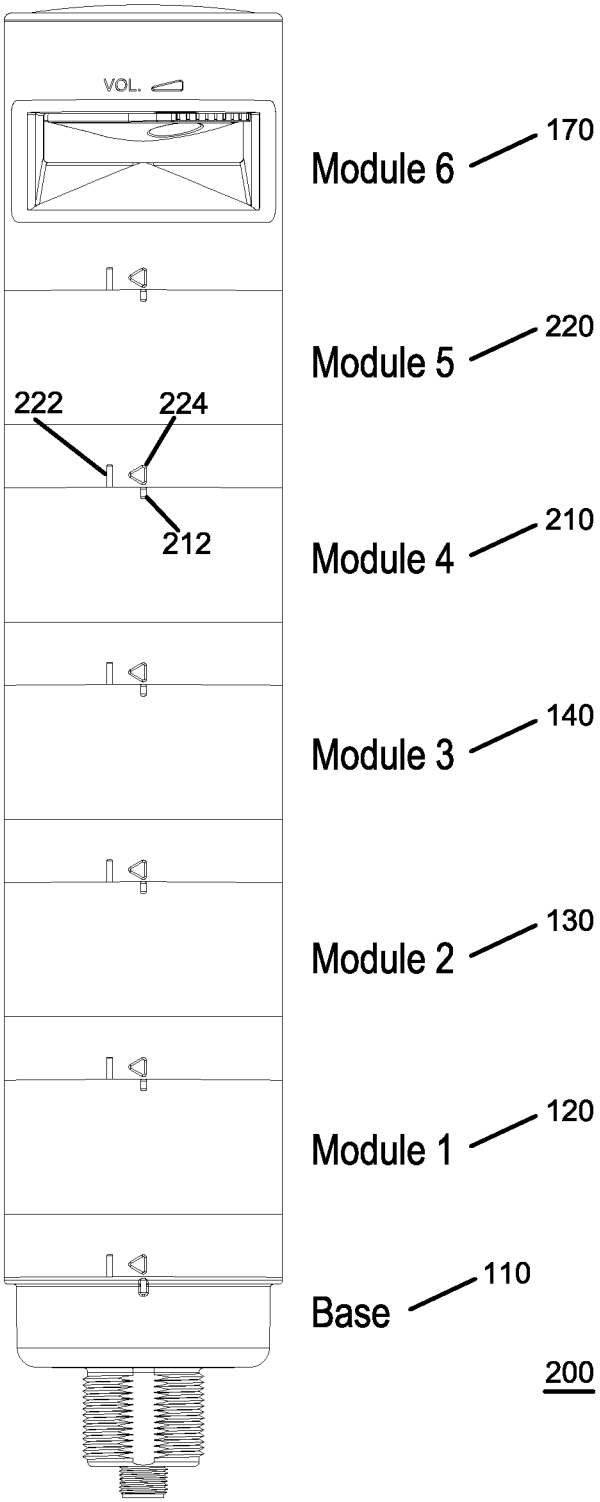
FIG. 2 illustrates another indicator assembly similar to the one shown in FIG. 1(*b*).
Figure 3A:
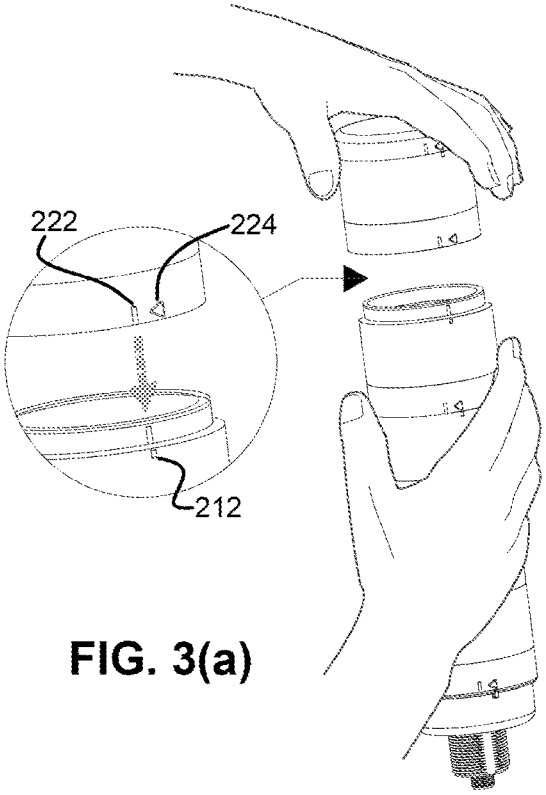
FIGS. 3(*a*) and 3(*b*) show attachment of one indicator module to another indicator module in a plurality of indicator modules in assembling an indicator assembly according to an aspect of the present disclosure.
Figure 3B:
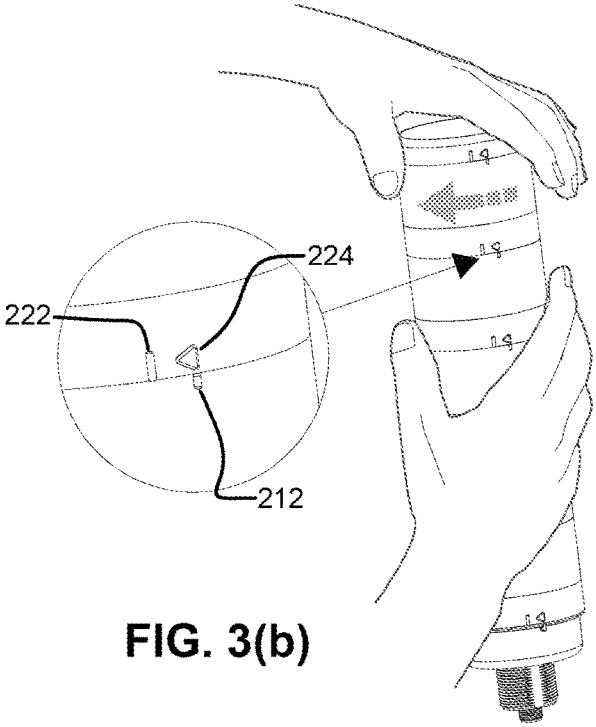

FIG. 2 shows an assembly (200) similar to that (160) shown in FIG. 1(*b*), except that it includes two additional visual modules, lower module (210), upper module (220). FIG. 2 further shows guide marks to assist in mounting two modules to each other by a bayonet-style mount. For example, to attach upper module (220) to lower module (210), a first mark (222) at the bottom of the upper module (220) is first aligned with a first mark (212) at the top of the lower module (210), as shown in FIG. 3(*a*). Then the two modules are pushed together longitudinally and then twisted axially relative to each other until locked, when a second mark (224) at the bottom of the upper module (220) is aligned with the first mark (212) of the lower module (210).

Figure 4:
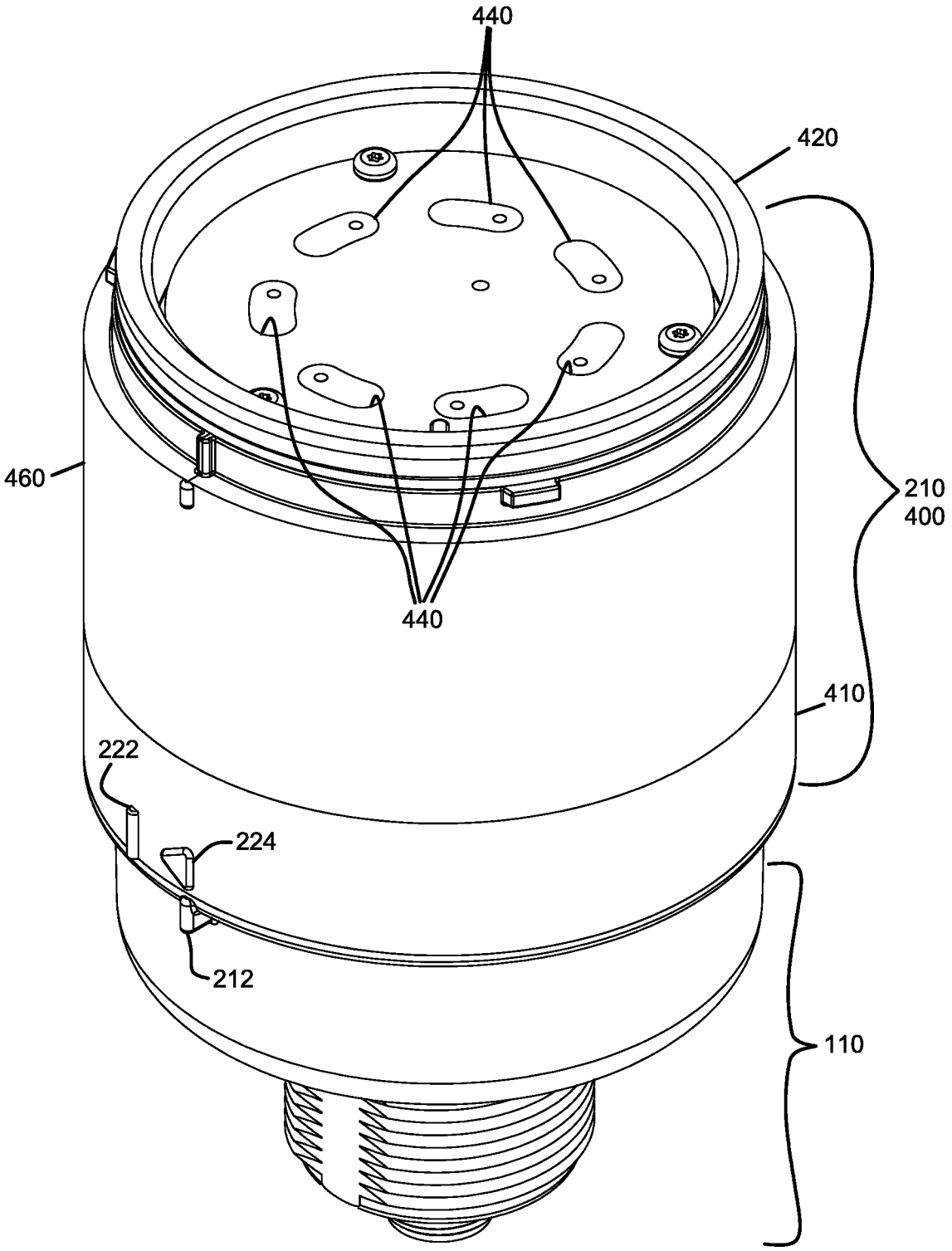
FIG. 4 is a top (referenced to an upright orientation of the assembly) perspective view of an indicator assembly with an indicator module mounted on a base according to an aspect of the present disclosure.
Figure 5:
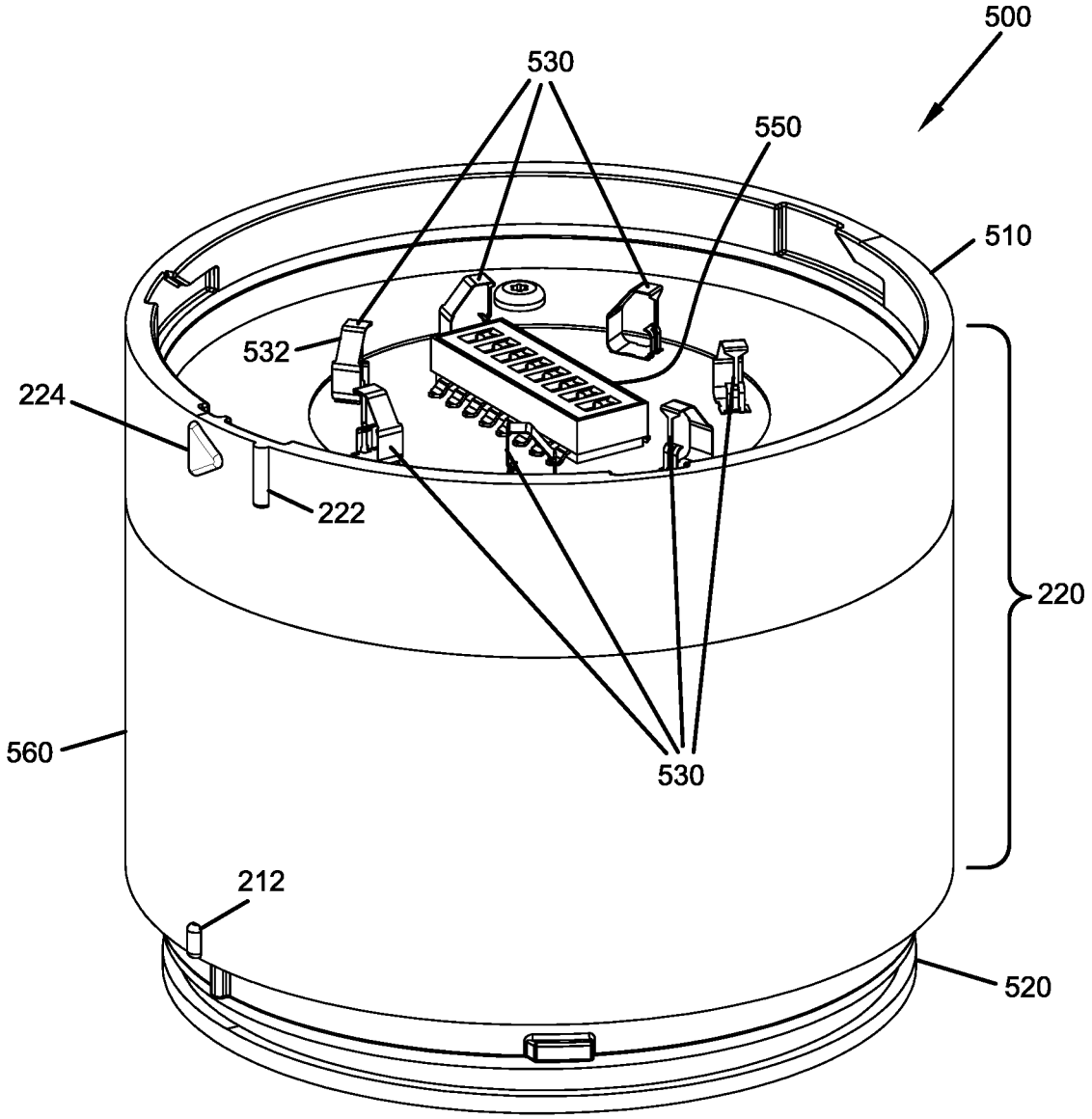
FIG. 5 is a bottom (referenced to an upright orientation of the assembly) perspective view of an indicator assembly according to an aspect of the present disclosure.

Referring to FIGS. 4 and 5, which show examples of two identical indicator modules, lower module (210), upper module (220), FIG. 4 being from a top/side perspective (references to an upright orientation of the assembly), and FIG. 5 being from a bottom/side perspective. Each module has a body portion (400, 500), which includes a bottom mounting portion (410, 510) for mounting the module to an electrical module, such as another module, or a base (110 in FIG. 4; not shown in FIG. 5), below. Each body portion in this case also includes a top mounting portion (410, 520) for attachment to another module, or cap. Each module in these examples also includes a set of bottom electrodes (530 in FIG. 5; not shown in FIG. 4) near or at the bottom mounting portion (410, 510). Each module further includes a set of top electrodes (440 in FIG. 4; not shown in FIG. 5) corresponding to the respective bottom electrodes (530). In the example shown in FIG. 4, the base (110) also has a set of electrodes (not shown) similar to the top electrodes (440) for lower module (210). When a module (210, 220) is mounted on the electrical module, such as another indicator module or a base (110) below, the bottom electrodes (530) of upper module (220) are in contact with the electrodes in the electrical module, such as the top electrodes (440) of lower module (210) or the electrodes (118) of the base (110). See FIG. 9 for an example in which an indicator module body portion (500) is mounted on a base (110).

In this example, the top electrodes (440) are substantially flat and face the direction of the longitudinal axis of the lower module (210). The electrodes (118 in FIG. 9) in the base (110) have a similar structure. The bottom electrodes (530) are flexible so that when the upper module (220) is mounted on the lower module (210) or a base (110), the bottom electrodes (530) are biased against the corresponding top electrodes (440) (or electrodes (118) in the base) to ensure proper electrical contact. In addition, the bottom electrodes (530), in one example, include a sloped section (532) obliquely facing the direction in which the module rotates relative to the module being attached thereto. This configuration ensures proper flex of the bottom electrodes (530) and prevents any protrusion on the top surface (624 in FIG. 8) of the top circuit board (620 in FIG. 8) of the module being attached to from impeding the relative rotation and proper locking between the two modules.

Not all indicator modules need to have both top and bottom electrodes, and top and bottom mounting portions. An indicator module, such as the audio module 170, can be designed to always be the top module in a stack, and as such, needs only to have a bottom mounting portion and bottom electrodes (details not shown).

As shown in FIG. 5, an indicator module in these examples further includes a switch module (550), which in the example shown in FIG. 5, is supported at the bottom of the upper module (220) but can be anywhere accessible by a user. The switch module (550) is used to selectively connect an indicator circuit (to be described later) in the upper module (220) to one of the bottom electrodes (530).

The body portion (400, 500) of each indicator module (210, 220) can also include a housing wall (460, 560), which in the case of an optical indicator module, may be a transparent or translucent wall for transmitting light emitted by an illumination source contained therein.

Figure 6:
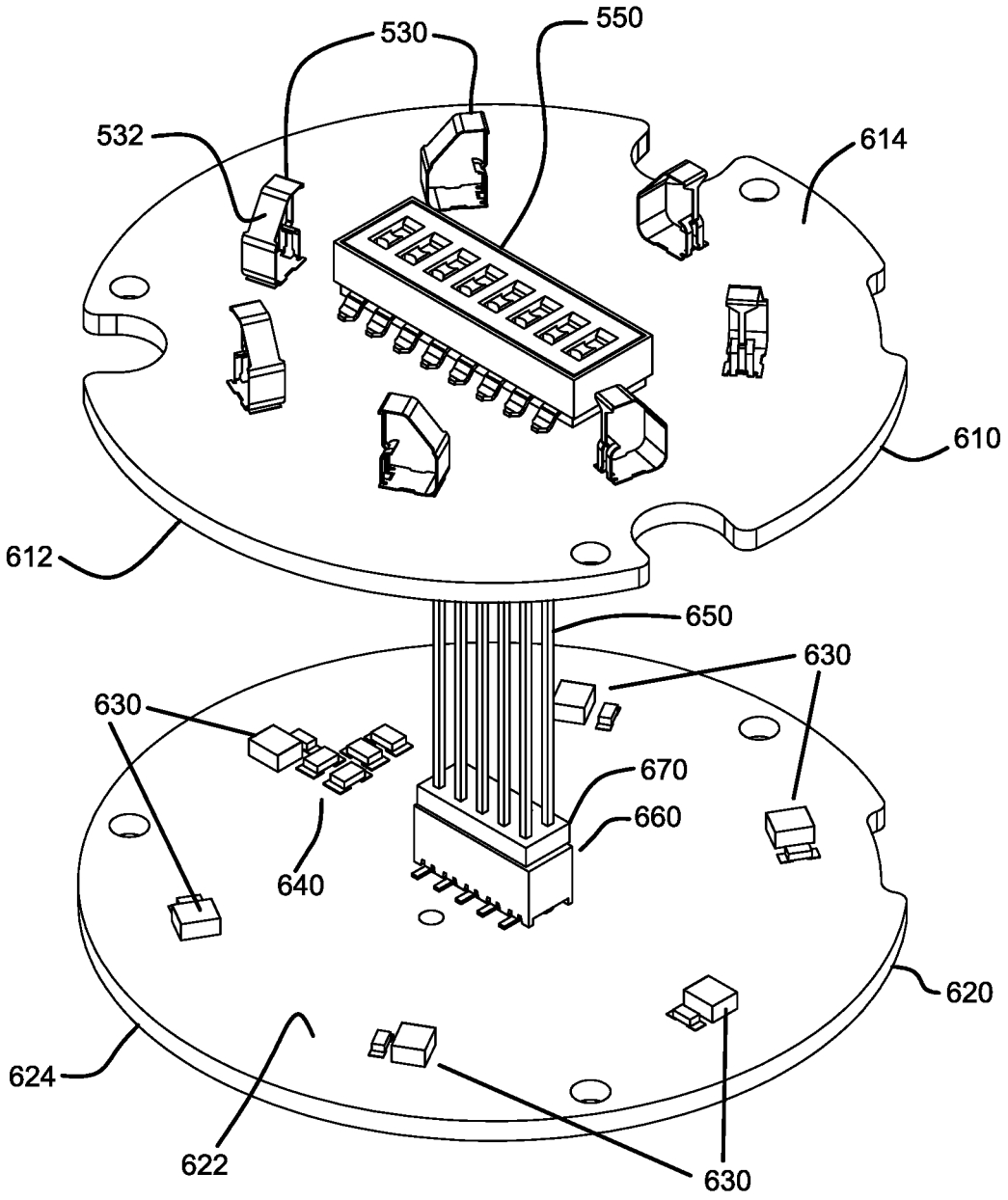
FIG. 6 is a bottom (referenced to an upright orientation of the assembly) perspective view of the indicator assembly shown in FIG. 5 but without the housing.
Figure 7:
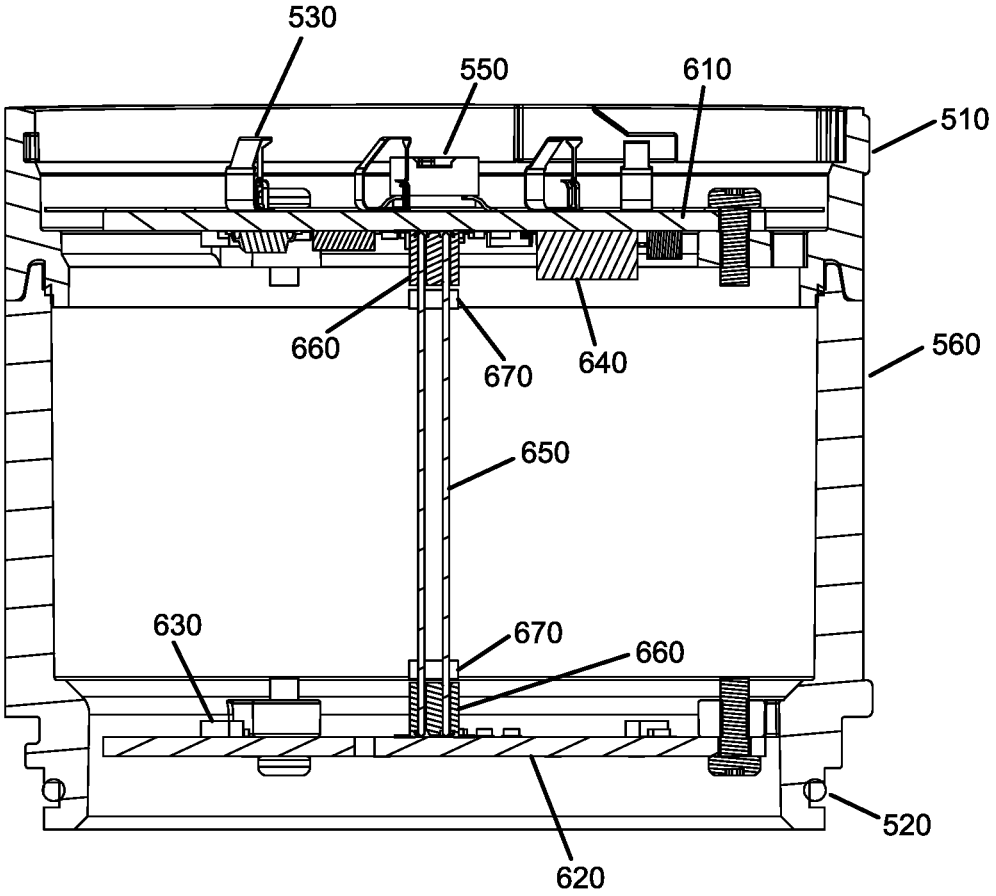
FIG. 7 is a side view of the indicator assembly shown in FIG. 5.

Referring to FIG. 6, the various electrical and electronic components (640) in an indicator module (210, 220) in this example are supported on a bottom circuit board (610) and a top circuit board (620). For example, the bottom electrodes (530) and switch module (550) are supported on the bottom side (614) of the bottom circuit board (610), and the top electrodes (440) are supported on the top side (624) of the top circuit board (620).

Each module further includes an indicator circuit, which in this example includes light sources (630), such as light emitting diodes (LEDs) and associated electronic components (640), which can include, for example, a driver circuit, blinker circuit and protection circuit. In this case, the light sources (630) are mounted on the bottom surface (622) of the top circuit board (620) and (not shown) on the top surface (612) of the bottom circuit board (610). In this case, the light sources (630) are also distributed near the periphery, or housing wall (560) of the upper module (220). With additional reference to FIG. 7 which shows a cross-sectional view of an indicator module, the bottom circuit board (610) and top circuit board (620) are interconnected via the conductors (650) and connectors (660), and with the light sources (630), other electronic components (640), bottom electrodes (530) and switch module (550) mounted the appropriate circuit boards (610, 620). A spacer (670) accommodates the conductors (650) passing through the spacer (670), and space the conductors (650) apart from each other.

Figure 8B:
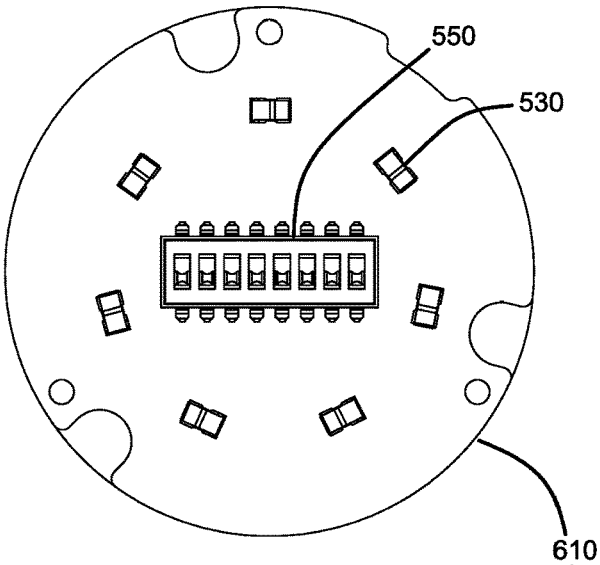
FIGS. 8(*a*), (*b*) and (*c*) are, respectively, bottom, side and top views (referenced to an upright orientation of the assembly) of the components of the indicator module shown in FIG. 6.
Figure 8A:
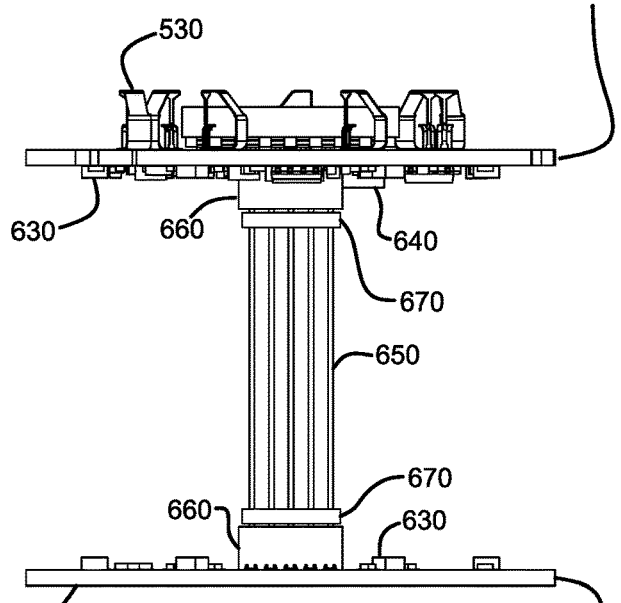
Figure 8C:
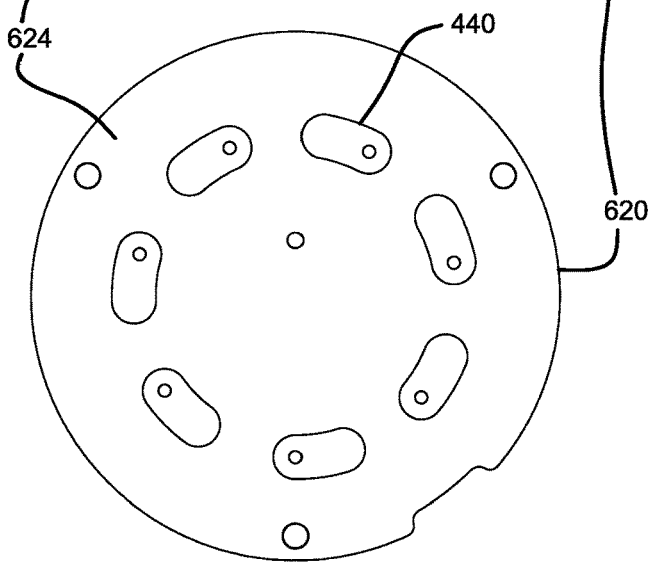

With further reference to FIG. 8, each indicator module (210, 220) in this example further includes conductors (650) connecting the top electrodes (440 in FIGS. 4 and 8; not shown in FIG. 5 or 6) to the bottom electrodes (not shown in FIG. 4; 530 in FIGS. 5 and 6) within each module via connectors (660) and conductive lines (not shown) on the top and bottom circuit boards. The connectors (660) permit the top and bottom circuit boards (610, 620) to be readily assembled together or disassembled. The conductors (650) in this case are disposed in an interior region relative to the light sources (630). With this arrangement, shadows of the conductors (650) cast by the light sources (630) are reduced as compared to the arrangements in which the conductors are disposed near the periphery and light sources are disposed in a more interior region of the module.

Figure 9:
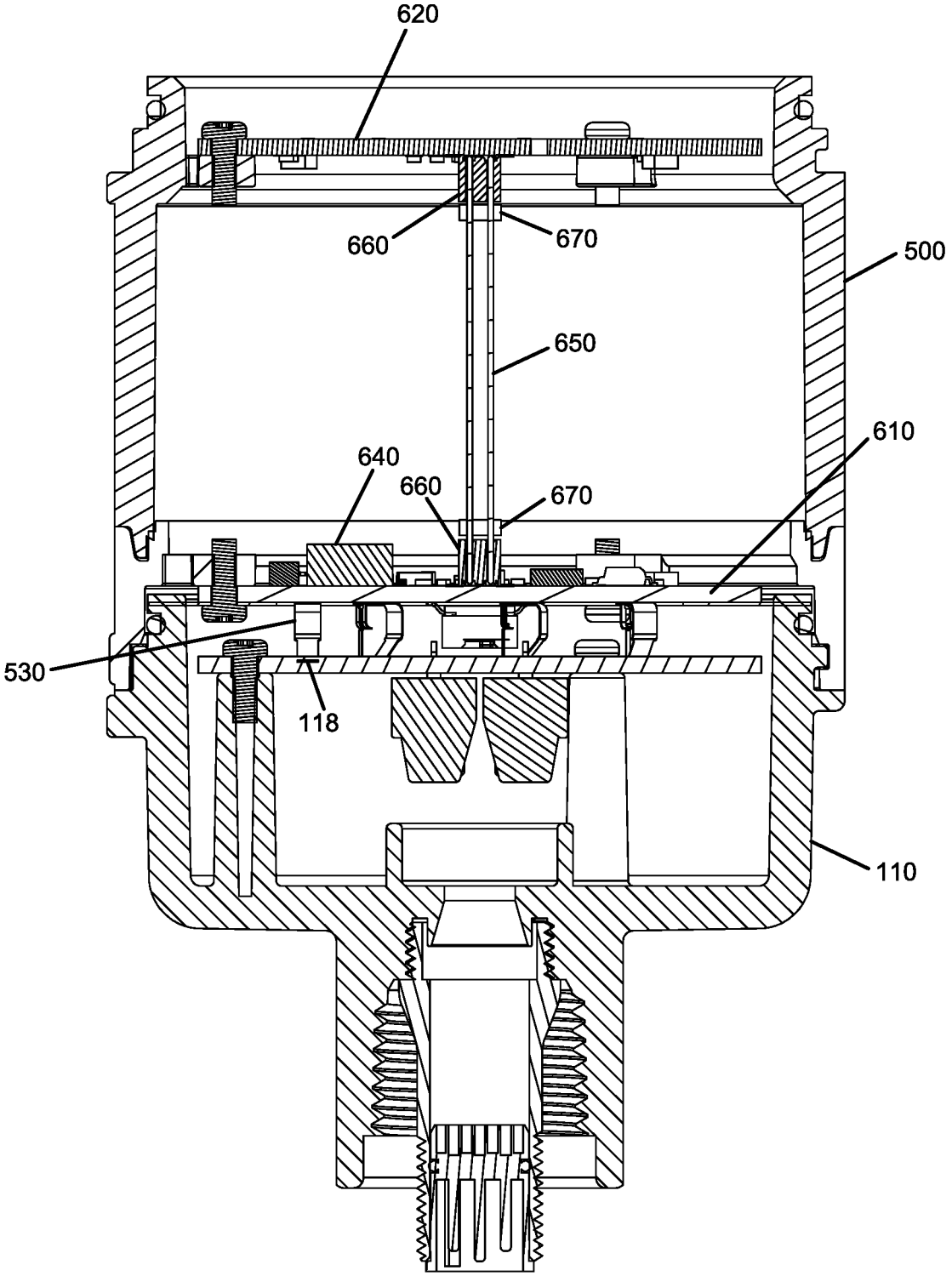
FIG. 9 is a side view of the assembly shown in FIG. 4.
Figure 11:
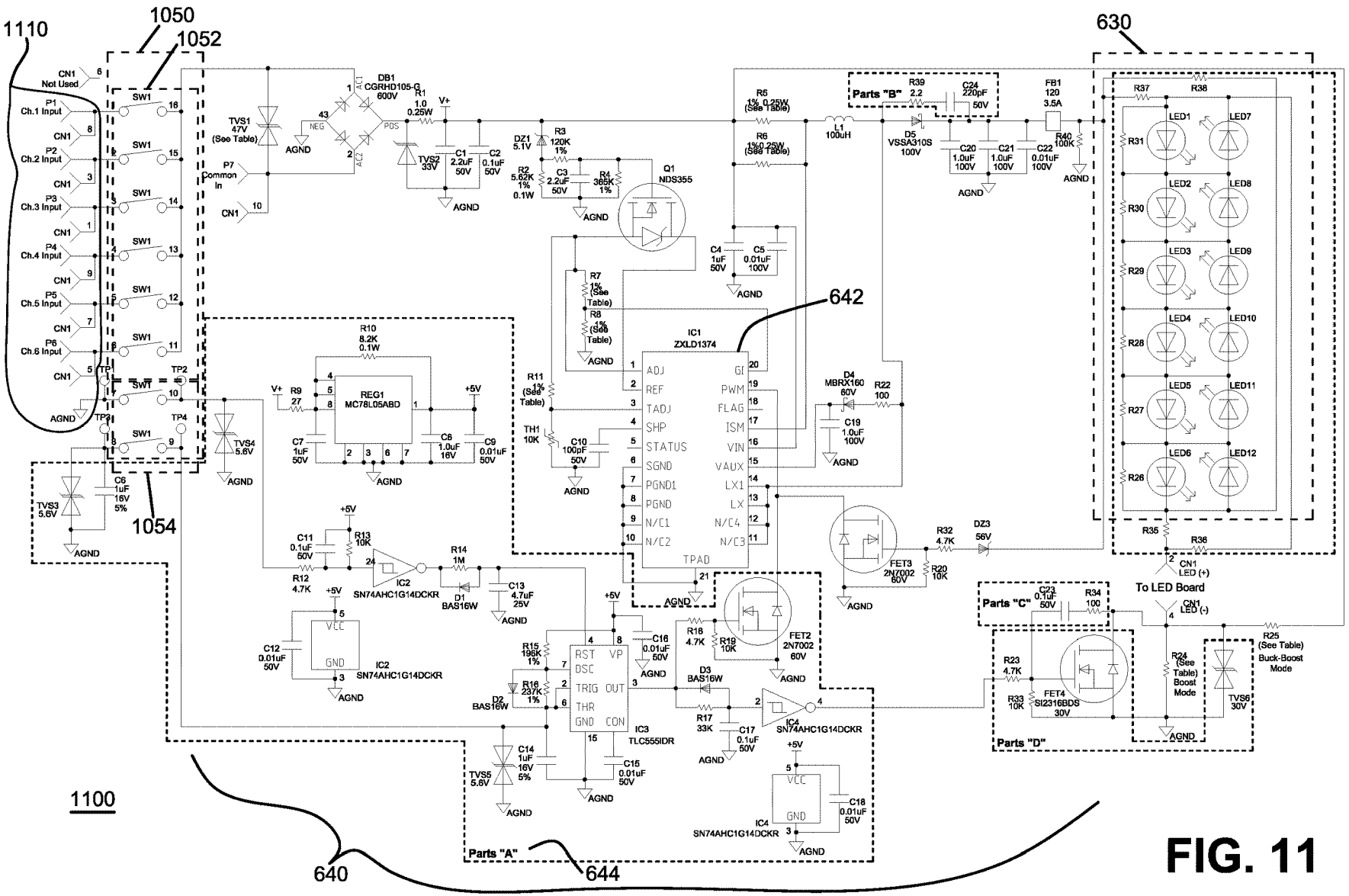
FIG. 11 shows an example circuit diagram of the electronics in a visual indicator module according to an aspect of the present disclosure.

FIG. 9 shows a cross-sectional view of an indicator module, with the bottom circuit board (610) and top circuit board (620) interconnected via the conductors (650) and connectors (660), and with the bottom electrodes (530), other electronic components (640), and the electrodes (118) of the base (110).

When an indicator assembly (100 or 160) is assembled, there are several conductive paths running through all the modules in the assembly. Several such conductive paths (logically labeled "M1" through "M6" in FIG. 10(*b*)) are connected to respectively signal sources (symbolically illustrated as a set of switches (1060) in FIG. 10(*b*)) such as a controller (not shown) via the connector (116; see FIG. 10(*c*) for pin-out and (d) for identification of the wires). One or more such conductive paths can also be connected to a common terminal, such as ground. Each conductive path includes one conductor (650) and corresponding top and bottom electrodes (440, 530) in each module.

Regarding the switch module (550), one function of the switch is to selectively interconnect the indicator circuit, such as visual indicator circuit (630, 640), with one or more of the conductive paths. For example, the indicator circuit in each indicator module can be connected between the common terminal (e.g., ground) and, via the switch module, selectively to one of the signal sources. The connection can be made, for example, to the bottom electrodes (530) via conductive lines (not shown) in the circuit board (610). The switch module (550) can be any suitable connecting device, including switches such as DIP switches, rotary switches, sliding switches, and the like. Though less convenient, the switching module (550) can also be a jumper arrangement. In an example, shown in FIG. 10(*a*), a part of a DIP switch (1050) is used for the purpose of selectively connecting an indicator circuit to one of the conductive paths. In this case, the DIP switch (1050) has several individual switches (1052, 1054), a subgroup (1052) of which serves to make the selective connections. For example, if the switch element in position "3" in a DIP switch in a module is switched to "ON," the module is "seen" as M3, or Module 3, by the controller, regardless of the physical location of the indicator module in the sequence of modules in the assembly.

As a further example, two or more indicator modules, each occupying a different physical location, in an indicator assembly can be configured to be the same logical module by appropriate setting of the switch module (550). For example, if the switch element in position "3" in a DIP switch in each of two or more indicator modules in an indicator assembly is switched to "ON," each of the modules is "seen" as M3, or Module 3, by the controller. Both or all of the modules set to M3 will be activated. For example, in an indicator assembly (e.g., one as shown in FIG. 2) having both an audio indicator module and a visual indicator module, both indicator modules can be set to the same logical module (e.g., both physical Module 6 (170) and physical Module 4 (210) can be set to be logical Module 3, or M3). When the controller supplies power to the logical module (e.g., Module 3, or M3), both the audio and visual indicator modules will be activated and generate audio and visual signals, respectively. In another example, multiple visual indicator modules in an indicator assembly can be set to the same logical module to produce a desired array of visual signals, such as an array of lights of the same color or any other color pattern.

Other functions can be provided by the switch module (550, 1050). For example, a portion of the DIP switch (1050) can be used to affect the type of indication provided by Module 3 (assuming the switch element in position "3" is "ON"). For example, switch elements in positions "7" and "8" can be used to control whether the indicator module is active continuously or intermittently, and the frequency of intermittent indications (flashes or beeps).

A variety of electrical and electronic circuits can be used to implement specific functional aspects of the indicator module. For example, the circuit schematically shown in FIG. 11 can be used to build a visual indicator module designed for tower lights having up to six independent channels. In this example, a portion (1052) of the switch module (1050) is used to selectively connect the light sources (630) and other electronics (640) via one of the six conductive paths (1110). The circuit (640) includes, among other things, a driver (642) for powering the light sources (630) and timing circuit (644). Another portion (1054) of the switch module (1050) is used to control the blinking indication of the light sources (630). Other suitable circuits can be used, depending the specific desired operation.

In accordance with another aspect of the present disclosure, additional switches can be included in a indicator module (210,220) to enable additional functionalities of the module. The additional switches can be included in the form of additional individual switches (1052,1054) in the switch module (550,1050). Alternatively or in addition, they can be included, as in an exemplary embodiment shown in FIG. 12, in the form of individual switches (1272,1274) in one or more additional switch modules (1270).

For example, the light sources (630) can each be a multi-color LED or a group of discrete single-color LEDs of different colors, and switches (1272,1274) can be connected to power respective LEDs or color components of a multi-color LED to produce a desired color by mixing colors emitted by LEDs or LED components of different colors. For example, an RGB (red-green-blue) LED may provide seven different colors (turning on one, two, three colors); an RGBA (red-green-blue-amber) LED may provide fourteen colors (turning on one, two, three colors) or more. TABLE I below shows an example in which four switches (5B-8B) in a DIP switch module (1270) are used to generate fourteen colors. In this example, the circuit is configured such that turning all switches (5B-8B) on does not result in a state in which all four color components are on; instead, a demonstrative state is reached, which can be, for example, cycling through all fourteen colors while the LEDs are flashing.

TABLE I

Effect of Switch Positions For Switch Module (1270)

| Assembly Options | | DIP Switch (1270) 1B | 2B | 3B | 4B | 5B | 6B | 7B | 8B |
|---|---|---|---|---|---|---|---|---|---|
| Color Selection | Red | | | | | | | | ON |
| | Green | | | | | | | ON | |
| | Yellow | | | | | | | ON | ON |
| | Blue | | | | | | ON | | |
| | Magenta | | | | | | ON | | ON |
| | Cyan | | | | | | ON | ON | |
| | White | | | | | | ON | ON | ON |
| | Amber | | | | | ON | | | |
| | Rose | | | | | ON | | | ON |
| | Lime Green | | | | | ON | | ON | |
| | Orange | | | | | ON | | ON | ON |
| | Sky Blue | | | | | ON | ON | | |
| | Violet | | | | | ON | ON | | ON |
| | Spring Green | | | | | ON | ON | ON | |
| | Color Demo | | | | | | | | |
| | Flash Demo | | | | | ON | ON | ON | ON |
| Flashing and Strobing | Solid On | | | | | | | | |
| | 0.5 Hz Flash | | | | ON | | | | |
| | 1.5 Hz Flash | | | ON | | | | | |
| | 3.0 Hz Flash | | | ON | ON | | | | |
| | 0.5 Hz Strobe | | ON | | | | | | |
| | 1.5 Hz Strobe | | ON | | ON | | | | |
| | 3.0 Hz Strobe | | ON | ON | | | | | |
| | Intensity Sweep | | ON | ON | ON | | | | |
| Intensity | High | | | | | | | | |
| | Low | ON | | | | | | | |

As further illustrated by the example of TABLE I, switches (1272,1274) can be connected to enable other functionalities in similar ways as the switches "7" and "8" (1054) described above. For example, switches 2B-4B can be connected to appropriate circuitry to cause the LEDs to flash or strobe at various frequencies, or to provide intensity sweep (pulse); switch 1B, as another example, can be connected to appropriate circuitry to cause the LEDs to emit light at various intensities.

As summarized in TABLE II below, the switching states of the switches (1052) in the other DIP-switch (550,1050) controls the logical position of each indicator module as described before.

TABLE II

Effect Of Switch Position For Switch Module (550, 1050)

| Assembly Options | | DIP Switches (550, 1050) 1 | 2 | 3 | 4 | 5 | 6 |
|---|---|---|---|---|---|---|---|
| Position | Module 1 | ON | | | | | |
| | Module 2 | | ON | | | | |
| | Module 3 | | | ON | | | |
| | Module 4 | | | | ON | | |
| | Module 5 | | | | | ON | |
| | Module 6 | | | | | | ON |

The user configurable indicator modules described above can also be used with other types of indicator modules, such as traditional tower light modules, to achieve desired configurations.

Figure 12:
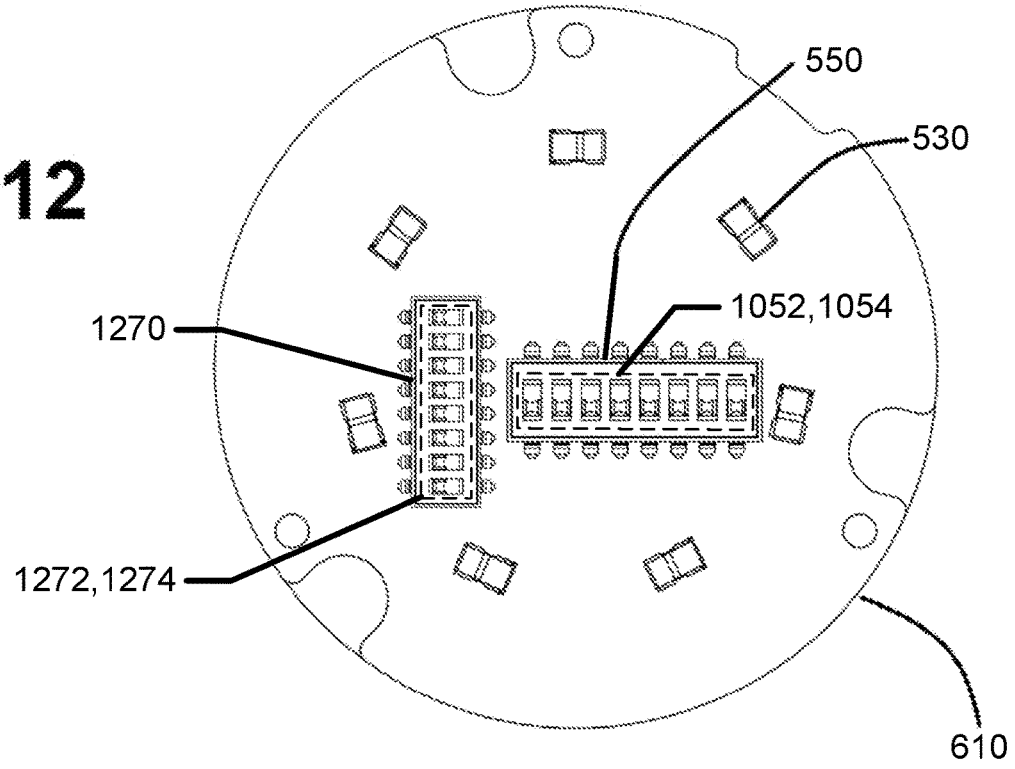
FIG. 12 shows a bottom view (referenced to an upright orientation of the assembly) of the components of the indicator module shown in FIG. 6 according to another embodiment.
Figure 13A:
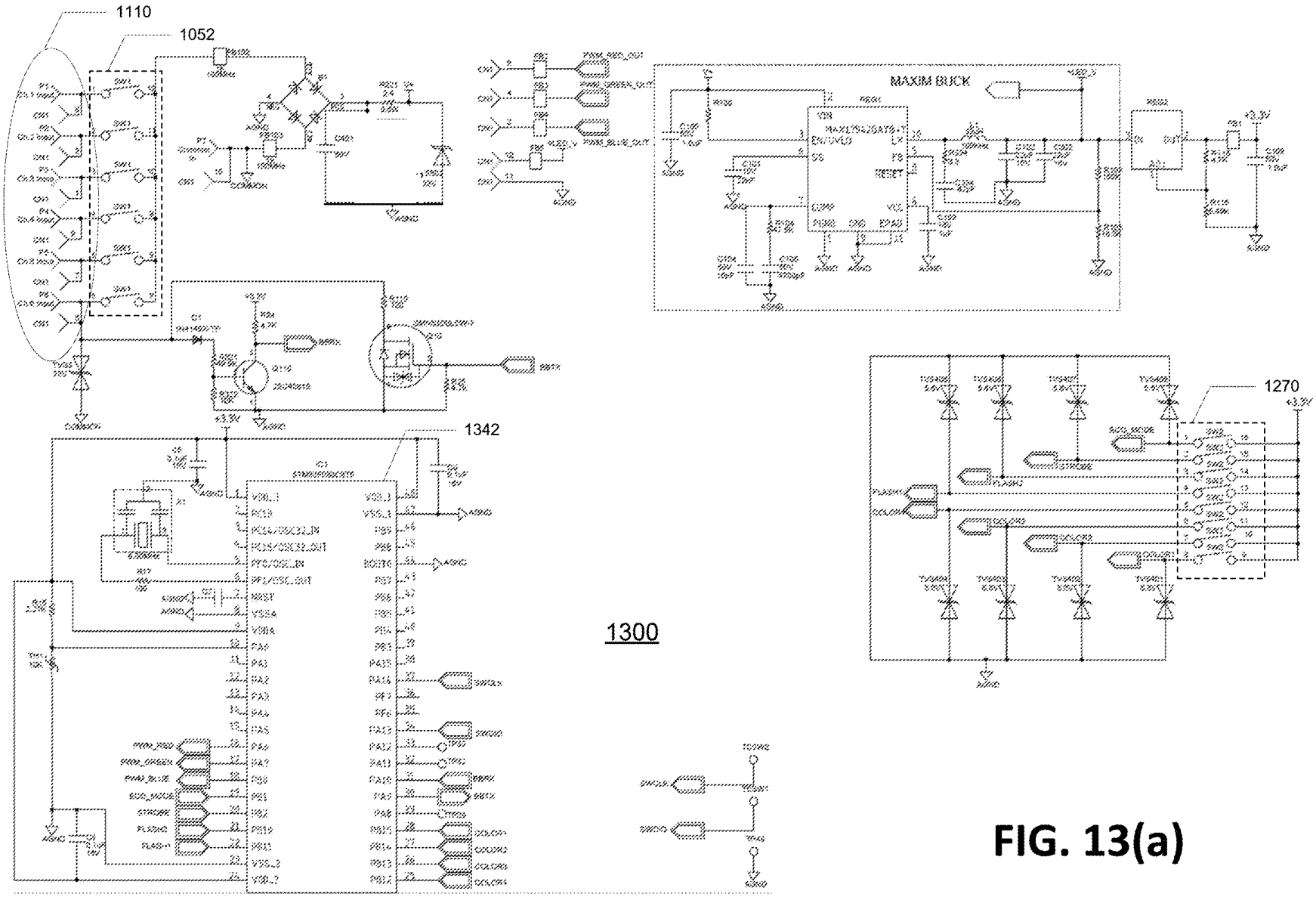
FIGS. 13(*a*) and 13(*b*) shows an example circuit diagram of the electronics in a visual indicator module according to an aspect of the present disclosure.
Figure 13B:
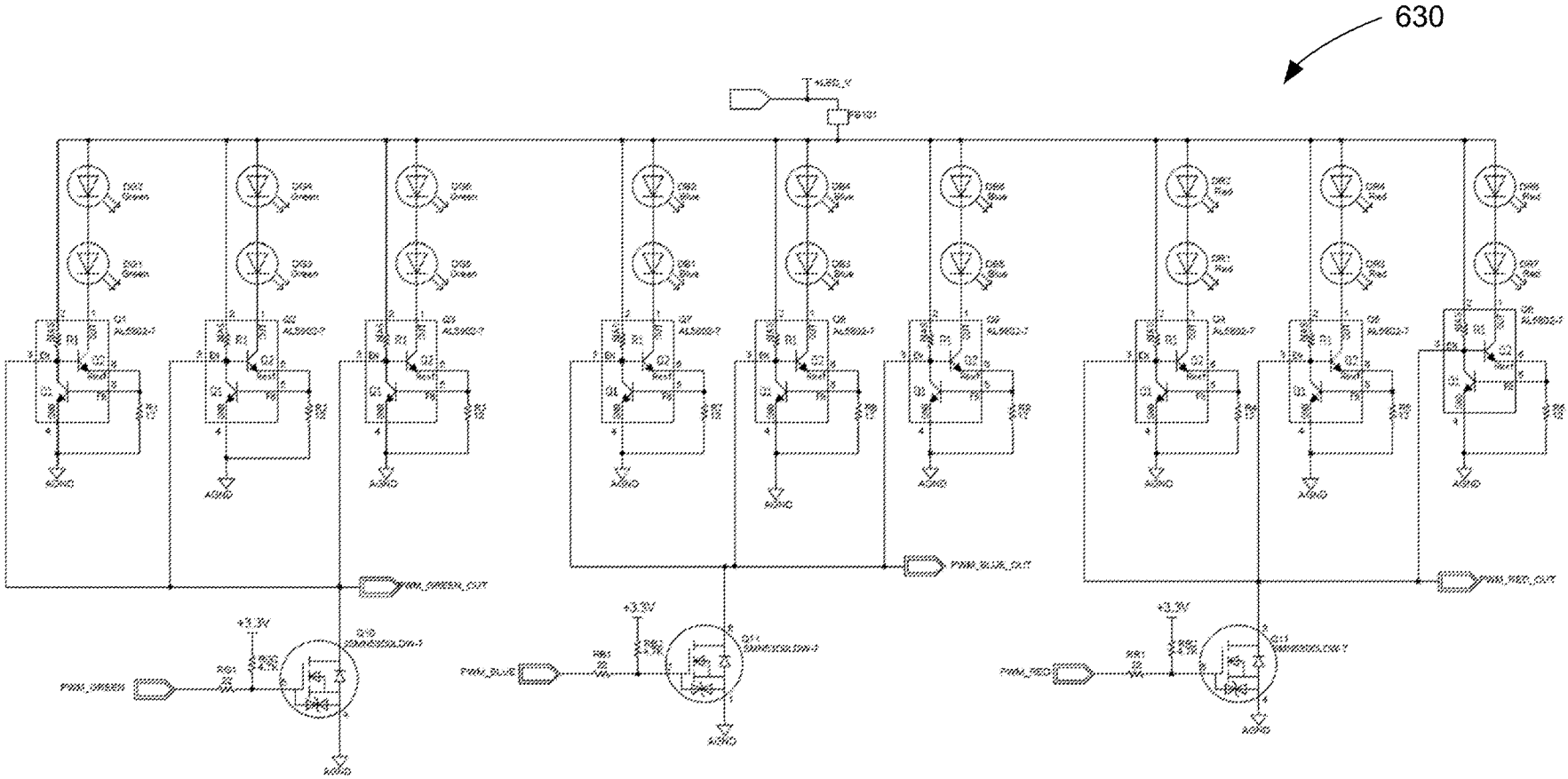

An example circuit, schematically shown in FIG. 13 can be used to build a visual indicator module designed for tower lights shown in FIG. 12 and capable of performing the various functions described above. In this example, a processor (1342) in the circuit (1300) is configured to receive inputs (in this example, COLOR1, COLOR2, COLOR3, COLOR4, FLASH1, FLASH2, STROBE and ECO_MODE) from the additional switch module (1270) generate control signals (in this example, PWM_RED, PWM_GREEN and PWM_BLUE) to control the level of power delivered to LED's of each color (red, green and blue). The control in this example is achieved by pulse-width modulation (PWM). The functions described above, such as mixing LED colors to obtain various color, cycling through colors, and intensity sweeping, can be achieved. Other suitable circuits can be used, depending the specific desired operation.

Thus, a device and method have been described, which, among other things, provide a high degree of flexibility in configuring modular indicator assemblies (tower lights and the like). By the use of a switch module inside an indicator module, the module can be configured to function as a module in any logical (electronic) position in a multi-indicator assembly, regardless of its location in the physical sequence of the indicator modules in the assembly. The arrangement of the conductive paths relative to optical indicator elements (e.g., LEDs) provides a reduction in shadowing from the conductive paths. Resilient, or flexible, electrodes can be used for proper inter-modular electrical connections.

Many modifications and variations of the examples disclosed herein, and numerous other embodiments of the invention can be made without exceeding the scope of the invention, which is to be measured by the claims hereto appended.

We claim:

1. An indicator module, comprising:

a first support surface;

a first plurality of electrodes disposed on the first support surface, each of the first plurality of electrodes comprising a flexible portion having a sloped section forming an oblique angle with the first support surface and having a lower end portion and an upper end portion disposed farther from the first support surface than the lower end portion;

a second support surface spaced apart from the first support surface along a longitudinal direction, the first and second support surface facing substantially away from each other along the longitudinal direction;

a second plurality of electrodes disposed on the second support surface;

a plurality of conductors elongated substantially in the longitudinal direction, each of the first plurality of electrodes being electrically connected to the a respective one of the second plurality of electrodes via a respective one of the plurality of conductors; and an indicator circuit electrically connected to one or more of the plurality of conductors and adapted to generate a human perceptible signal when the indicator circuit receives electrical power from the one or more of the plurality of the conductors.

2. The indicator module of claim 1, wherein first plurality of electrodes are positioned substantially along a circle defining a tangent direction at the position of each of the first electrodes, wherein the sloped section of each of the first plurality of electrodes faces substantially in a direction between the longitudinal direction and the tangent direction defined at the electrode.

3. The indicator module of claim 2, the flexible potion of each of the first plurality of electrodes further comprising a lower section extending substantially along the longitudinal direction from the first support surface to the lower end portion of the sloped section.

4. The indicator module of claim 2, the flexible potion of each of the first plurality of electrodes further comprising an upper section extending from the upper end portion of the sloped section along a direction substantially parallel to the first support surface.

5. The indicator module of claim 1, wherein each of the second plurality of electrodes comprises a flat contact area facing substantially in the longitudinal direction.

6. The indicator module of claim 1, wherein the indicator circuit comprises a plurality of light emitters surrounding the plurality of conductors.

7. The indicator module of claim 6, wherein the light emitters are arranged substantially along a circle defining through its center a longitudinal axis substantially along the longitudinal direction, the circle lying in a plane substantially parallel to the first support surface, and the plurality of conductors are disposed in proximity to the longitudinal axis.

8. The indicator module of claim 7, further comprising a spacer disposed between the first and second support surfaces, accommodating the plurality of conductors passing through the spacer, and spacing the plurality of conductors apart from each other.

9. The indicator module of claim 1, further comprising a switch module operatively connected to the first plurality of electrodes and to the indicator circuit and configurable to selectively operatively connect the indicator circuit to one or more of the first plurality of electrodes.

10. The indicator module of claim 9, wherein the switch module is configurable to selectively operatively connect the indicator circuit to one or more of the first plurality of electrodes independent of whether the indicator circuit is connected to any other one of the first plurality of electrodes.

11. The indicator module of claim 1, further comprising a body portion attached to at least one of the first and second support surfaces and having:

a first mounting portion of a first configuration proximal to the first plurality of electrodes; and a second mounting portion of a second configuration proximal to the second plurality of electrodes and having a mounting configuration of a second kind, the first and second configurations being adapted to enable the first mounting portion to engage a mounting portion of an external device and of the second configuration to form a mating attachment between the indicator module and the external device.

12. The indicator module of claim 11, wherein the first and second configurations are adapted to enable the first mounting portion to engage a mounting portion of an external device and of the second configuration to form a mating attachment between the indicator module and the external device when the indicator module is rotated relative to the external device about the longitudinal direction, wherein the sloped section of each of the first plurality of electrodes faces substantially in a direction between the longitudinal direction and a direction of motion of the electrode.

13. An indicator assembly kit, comprising a plurality of indicator modules of claim 11, wherein each of the second plurality of electrodes of the first one of the plurality of indicator modules and a corresponding one of the first plurality of electrodes of the second one of the plurality of indicator modules are adapted to form compressive contact with each other when the second mounting portion of the body portion of the first one of the plurality of indicator modules and the first mounting portion of the body portion of the second one of the plurality of indicator modules are in a mating attachment to each other.

14. An indicator assembly kit, comprising a plurality of indicator modules of claim 12, wherein each of the second plurality of electrodes of the first one of the plurality of indicator modules and a corresponding one of the first plurality of electrodes of the second one of the plurality of indicator modules are adapted to form compressive contact with each other when the second mounting portion of the body portion of the first one of the plurality of indicator modules and the first mounting portion of the body portion of the second one of the plurality of indicator modules are in a mating attachment to each other.

15. An indicator module, comprising:

a first support surface;

a first plurality of electrodes disposed on the first support surface;

a second support surface spaced apart from the first support surface along a longitudinal direction, the first and second support surface facing substantially away from each other along the longitudinal direction;

a second plurality of electrodes disposed on the second support surface;

a plurality of conductors elongated substantially in the longitudinal direction, each of the first plurality of electrodes being electrically connected to the a respective one of the second plurality of electrodes via a respective one of the plurality of conductors;

a spacer disposed between the first and second support surfaces, accommodating the plurality of conductors passing through the spacer, and spacing the plurality of conductors apart from each other; and an indicator circuit electrically connected to one or more of the plurality of conductors and adapted to generate a human perceptible signal when the indicator circuit receives electrical power from the one or more of the plurality of the conductors.

16. The indicator module of claim 15, wherein the indicator circuit comprises a plurality of light emitters surrounding the plurality of conductors.

17. The indicator module of claim 16, wherein the light emitters are arranged substantially along a circle defining through its center a longitudinal axis substantially along the longitudinal direction, the circle lying in a plane substantially parallel to the first support surface, and the plurality of conductors are disposed in proximity to the longitudinal axis.

18. An indicator assembly, comprising:

a first and second indicator modules, each of which comprising:

a body portion having a first mounting portion and a second mounting portion spaced apart from the first mounting portion along a longitudinal axis;

a first support surface proximal to the first mounting portion of the body portion;

a first plurality of electrodes disposed on the first support surface, each of the first electrodes comprises a flexible portion having a sloped section forming an oblique angle with the first support surface and having a lower end portion and an upper end portion disposed farther from the first support surface than the lower end portion;

a second support surface proximal to the second mounting portion of the body portion, the first and second support surface facing substantially away from each other along the longitudinal axis;

a second plurality of electrodes disposed on the second support surface;

a plurality of conductors elongated substantially in the longitudinal direction, each of the first plurality of electrodes being electrically connected to the a respective one of the second plurality of electrodes via a respective one of the plurality of conductors; and an indicator circuit electrically connected to one or more of the plurality of conductors and adapted to generate a human perceptible signal when the indicator circuit receives electrical power from the one or more of the plurality of the conductors;

the second mounting portion of the first indicator module and first mounting portion of the second indicator module being adapted to engage each other to form a mating attachment between the first and second indicator modules, each of the second plurality of electrodes of the first indicator module and a corresponding one of the first plurality of electrodes of the second indicator module are adapted to form compressive contact with each other when the second mounting portion of the first indicator module and the first mounting portion of the second indicator module are in a mating attachment to each other.

19. The indicator assembly of claim 18, wherein the first and second mounting portions are adapted to form a mating attachment between the first and second indicator modules when the second indicator module is rotated relative to the first indicator module about the longitudinal axis, wherein the sloped section of each of the first plurality of electrodes of the second indicator module faces substantially in a direction between the longitudinal axis and a direction of motion of the electrode when the second indicator module is rotated relative to the first indicator module about the longitudinal axis to form the mating attachment between the first and second indicator modules.

20. The indicator assembly of claim 19, further comprising a base module, comprising:

a body portion have a mounting portion;

a plurality of electrodes proximal to the mounting portion; and a plurality of conductors adapted to electrically connect the respective ones of the plurality of electrodes of the base module to one or more signal sources external to the indicator assembly, the mounting portion of the base module being adapted to engage the first mounting portion of the first indicator module or the second mounting portion of the second indicator module to form a mating attachment between the base module and the first or second indicator module, respectively, each of the plurality of electrodes of the base module and a corresponding one of the first plurality of electrodes of the first indicator module or the second plurality of electrodes of the second indicator module being adapted to form compressive contact with each other when the mounting portion of the base portion and the first mounting portion the of the first indicator module or the second mounting portion of the second indicator module are in a mating attachment to each other.

21. The indicator module of claim 15, the space spacing the plurality of conductors apart from each other in two dimensions substantially transverse to the longitudinal direction.

* * * * *